US007963297B2

(12) United States Patent
Huang et al.

(10) Patent No.: US 7,963,297 B2
(45) Date of Patent: Jun. 21, 2011

(54) DISPENSING HEAD FOR AIR PUMP

(76) Inventors: Ying-Che Huang, Chang-Hua (TW); Chun-Ming Huang, Chang-Hua (TW)

( * ) Notice: Subject to any disclaimer, the term of this patent is extended or adjusted under 35 U.S.C. 154(b) by 249 days.

(21) Appl. No.: 12/177,964

(22) Filed: Jul. 23, 2008

(65) Prior Publication Data

US 2010/0019491 A1 Jan. 28, 2010

(51) Int. Cl.
*F16K 15/20* (2006.01)

(52) U.S. Cl. ..... 137/231; 137/223; 285/354

(58) Field of Classification Search ..... 137/223, 137/231; 285/354
See application file for complete search history.

(56) References Cited

U.S. PATENT DOCUMENTS 2,112,519 A * 3/1938 Jay ..... 137/231
2,451,277 A * 10/1948 Crowley ..... 152/415
5,746,243 A * 5/1998 Franke ..... 137/231
5,975,109 A * 11/1999 Wu ..... 137/231
6,260,572 B1 * 7/2001 Wu ..... 137/231
6,276,391 B1 * 8/2001 Wu ..... 137/223
6,904,932 B1 * 6/2005 Haraughty ..... 137/231
6,994,380 B2 * 2/2006 Cooke, Jr. ..... 285/354
2004/0055641 A1 * 3/2004 Ostrowiecki ..... 137/223
2006/0269638 A1 * 11/2006 Huang ..... 425/130

* cited by examiner

*Primary Examiner* — John Rivell
*Assistant Examiner* — Kevin Murphy

(57) ABSTRACT

A dispensing head for an air pump includes a sleeve connected to the air pump and a chamber is defined in an end of the sleeve. The end having the chamber of the sleeve is received in a housing and a mount piece is securely received in the housing. A first seal ring is mounted to the mount piece and in contact with an inner periphery of the chamber. The mount piece includes a plurality of inner threads defined axially in a central passage in the mount piece, so that the threaded section of a French valve is threadedly connected to the inner threads. A second groove is defined in the mount piece and a second seal ring is engaged with the second groove. The second seal ring is mounted to a neck of the French valve.

9 Claims, 7 Drawing Sheets

DISPENSING HEAD FOR AIR PUMP

BACKGROUND OF THE INVENTION

1. Field of the Invention

The present invention relates generally to an air pump, and more particularly to a dispensing head of the air pump that is able to be quickly and firmly connected to any types of French valves.

2. The Prior Arts

FIG. 1 shows a connection of a conventional dispensing head 71 and a French valve 60 which includes a cylindrical portion having a first threaded section 61 and a second threaded section 62 located on the cylindrical portion with a narrowed neck connected between the first and second threaded sections 61, 62. An inlet valve 63 is connected on the second threaded section 62. The diameter of the first threaded section 61 is larger than the diameter of the second threaded section 62. The French valve 60 is used widely to bicycle tires. The dispensing head 71 includes a connection portion 711 which is threadedly connected to the first threaded section 61 so that the second threaded section 62 and the inlet valve 63 are located in the dispensing head 71. A seal member 712 is located within the dispensing head 71 and seals the connection between the first threaded section 61 and the connection portion 711. The air from the air pump is delivered into the inlet valve 63 of the tire via the dispensing head 71.

FIG. 2 shows an adaptor 80 that can be connected between the French valve 60 and an American valve 72. The adaptor 80 includes a connection passage 81 with which the second threaded section 62 of the French valve 60 is engaged. A space 82 is defined in an end of the adaptor 80 and communicates with the connection passage 81. A seal ring 83 is received in the space 82 and mounted onto the neck of the French valve 60 to prevent from air leakage.

The above-mentioned two dispensing head 71 and the adaptor 80 are invented by the applicant and welcomed in the market. However, another latest type of French valve 50 as shown in FIG. 3 is developed and the latest French valve 50 replaces the first threaded section 61 with a non-thread tube 51 and the second threaded section 52 and the inlet valve 53 are maintained. The latest French valve 50 can only be cooperated with the adaptor 80 mentioned above. Nevertheless, the adaptor is designed for connection with the American valve 72 and the latest French valve 50 has an advantage of larger air inlet volume feature, so that most of the users specially for racing bicyclers definitely choose the dispensing head that is designed for the French valve rather than the latest French valve 50 as shown in FIG. 3.

SUMMARY OF THE INVENTION

A primary objective of the present invention is to provide a dispensing head for an air pump, which can be threadedly connected to a latest French valve.

According to the present invention, a dispensing head for an air pump is provided and comprises a sleeve connected with the air pump and a chamber is defined in an end of the sleeve. A housing has a first connection portion defined in a first end thereof and a through hole is defined through a second end of the housing. The end having the chamber of the sleeve is received in the housing. A mount piece is received in the housing by connecting the first connection portion with the second connection portion of the mount piece. A first groove is defined in an outside of the mount piece and a first seal ring is engaged with the first groove. A first end of the mount piece is inserted in the chamber and the first seal ring is in contact with an inner periphery of the chamber. A plurality of inner threads are defined axially in a central passage in the mount piece and are connected with the threaded section of a French valve. A second groove is defined in the mount piece and located close to a second end of the mount piece. A second seal ring is engaged with the second groove and mounted to a neck of the French valve.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
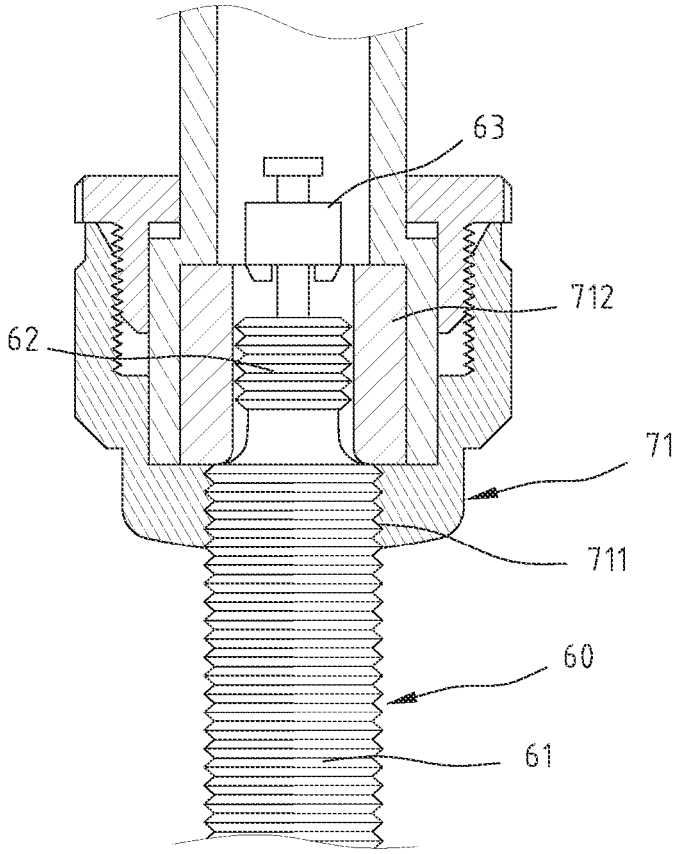
FIG. 1 (PRIOR ART)
FIG. 1 is a cross sectional view to show the connection of a conventional dispensing head and a French valve.
Figure 2:
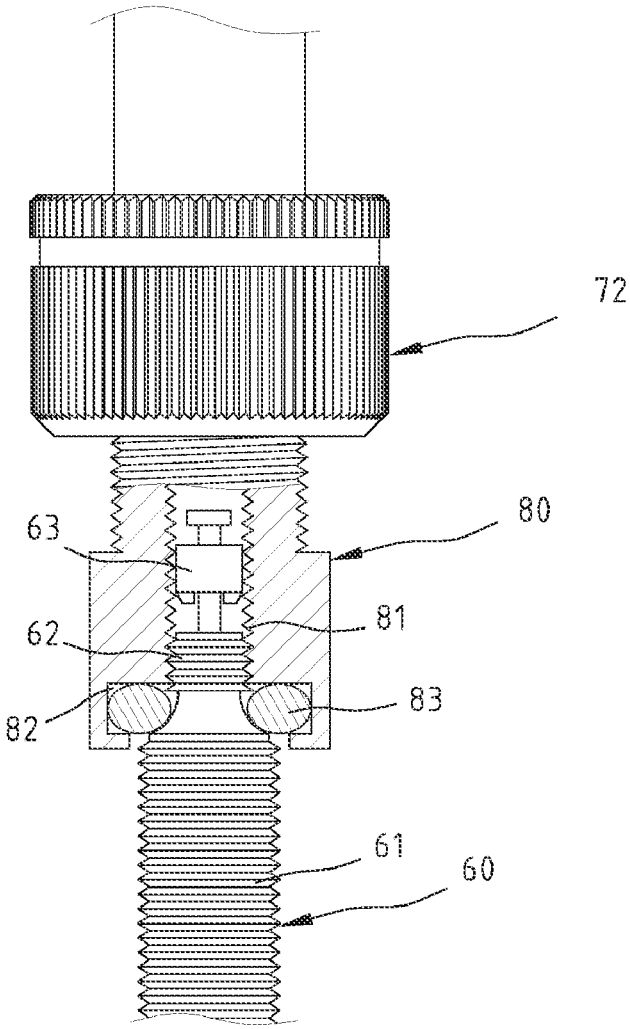
FIG. 2 (PRIOR ART)
FIG. 2 is a cross sectional view to show the connection of a conventional adaptor connected between an American valve and a French valve.
Figure 3:
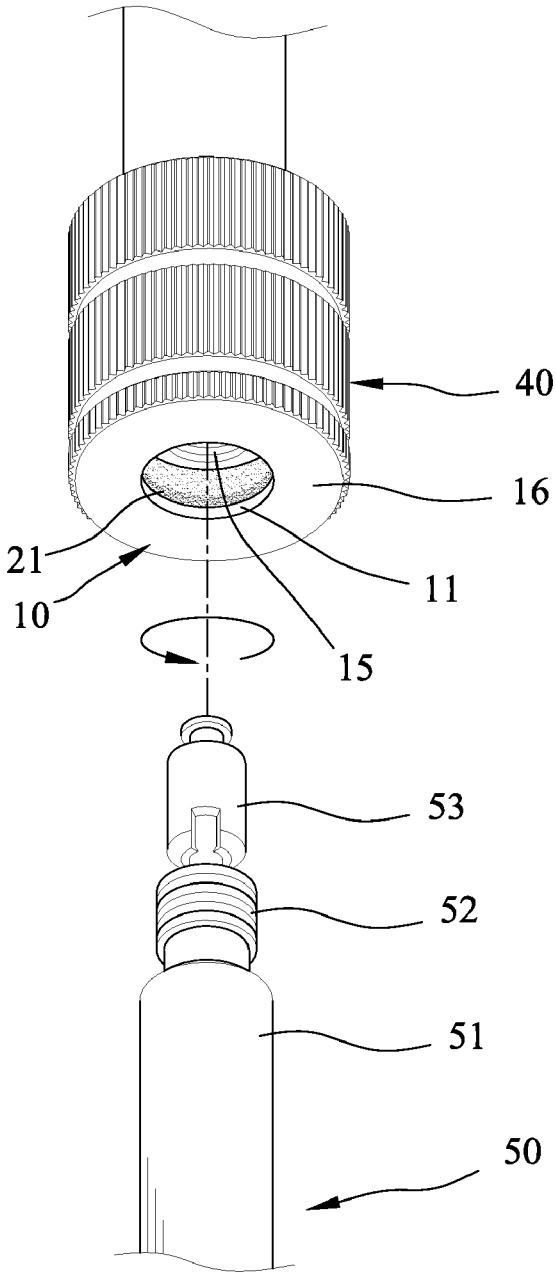
FIG. 3 is an exploded view to show the French valve and the dispensing head of the present invention.
Figure 4:
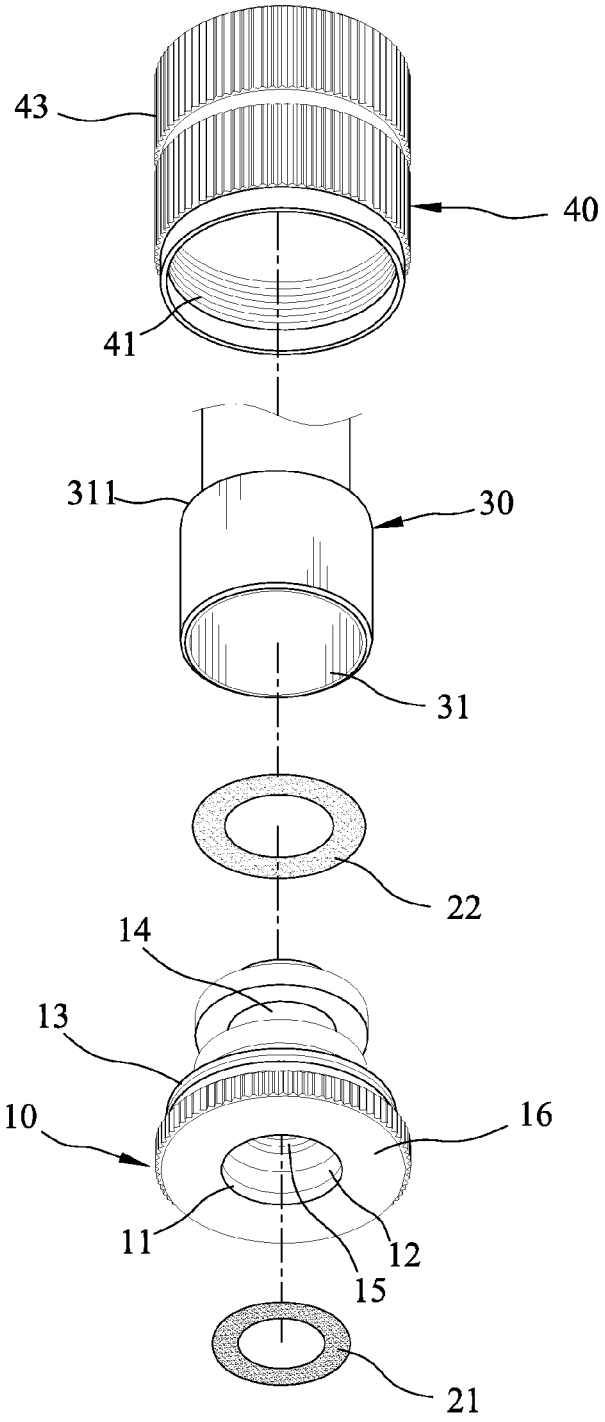
FIG. 4 is an exploded view to show the parts of the dispensing head of the present invention.
Figure 5:
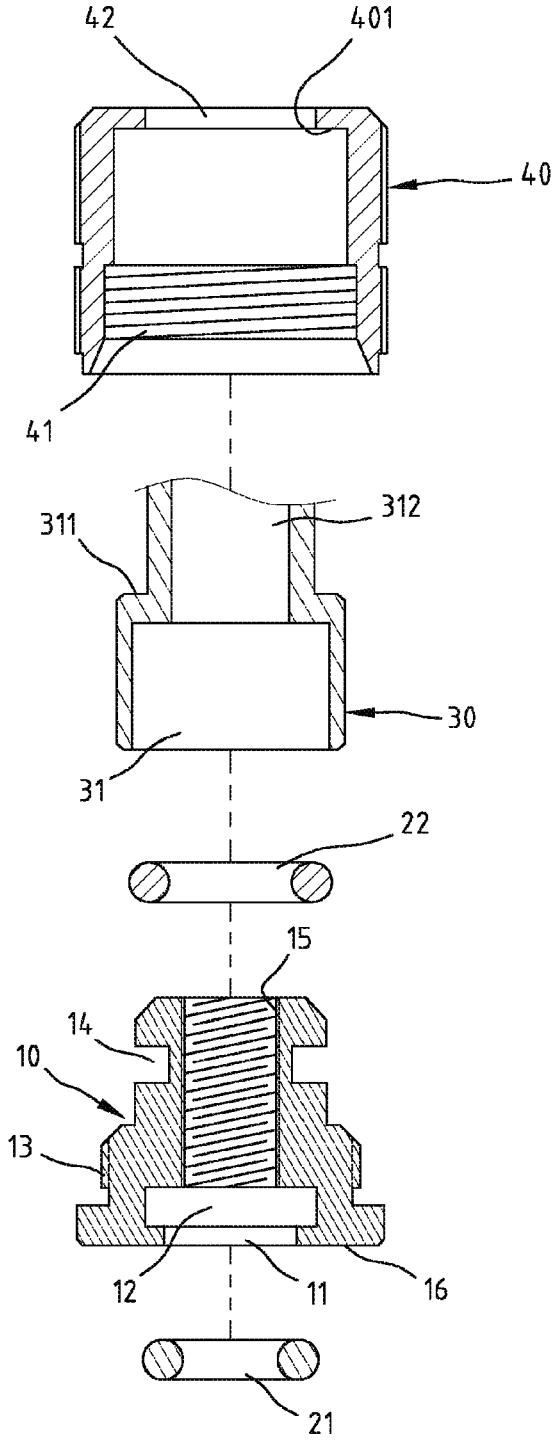
FIG. 5 is a cross sectional view to show the parts of the dispensing head of the present invention.

With reference to the drawings and in particular to FIGS. 3 to 5, a dispensing head for an air pump according to the present invention comprises a sleeve 30 which includes a passage 312 defined therethrough and a chamber 31 is defined in an end of the sleeve 30. The chamber 31 communicates with the passage 312 which is connected with a hose of the air pump (not shown). The diameter of the chamber 31 is larger than the diameter of the passage 312 so as to define a stepped surface 311 between the enlarged end having the chamber 31 and the tubular portion in which the passage 312 is defined. A housing 40 is mounted to the end having the chamber 31 and has a first connection portion 41 defined in a first end thereof and a through hole 42 is defined through a second end of the housing 40. The end having the chamber 31 of the sleeve 30 is received in the housing 40 and the tubular portion of the sleeve 30 extends through the through hole 42. An inner end 401 is defined in the inner end of the first end of the housing 40 and engaged with the stepped surface 311 of the sleeve 30. A serrated outer surface 43 is defined in an outside of the housing 40. A mount piece 10 has a first groove 14 defined in an outside thereof and a first seal ring 22 is engaged with the first groove 14. A second connection portion 13 is defined in the outside of the mount piece 10 and connected with the first connection portion 41 so as to receive the mount piece 10 in the housing 40. A first end of the mount piece 10 is inserted in the chamber 31 and the first seal ring 22 is in contact with an inner periphery of the chamber 31. A plurality of inner threads 15 are defined axially in a central passage in the mount piece 10. A second groove 12 is defined in the mount piece 10 and located close to a second end of the mount piece 10. A second seal ring 21 is engaged with the second groove 12. The first and second seal rings 22, 21 are preferably made by rubber.

Figure 6:
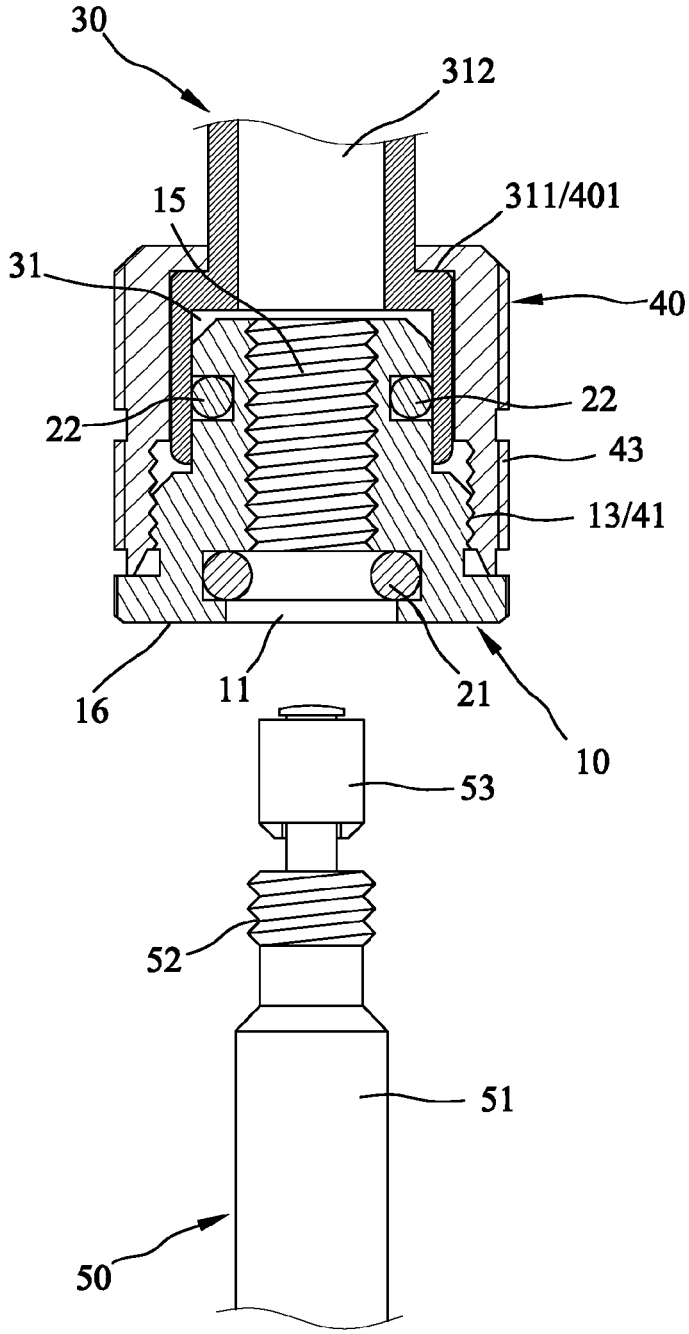
FIG. 6 is a cross sectional view to show the dispensing head of the present invention and a French valve.
Figure 7:
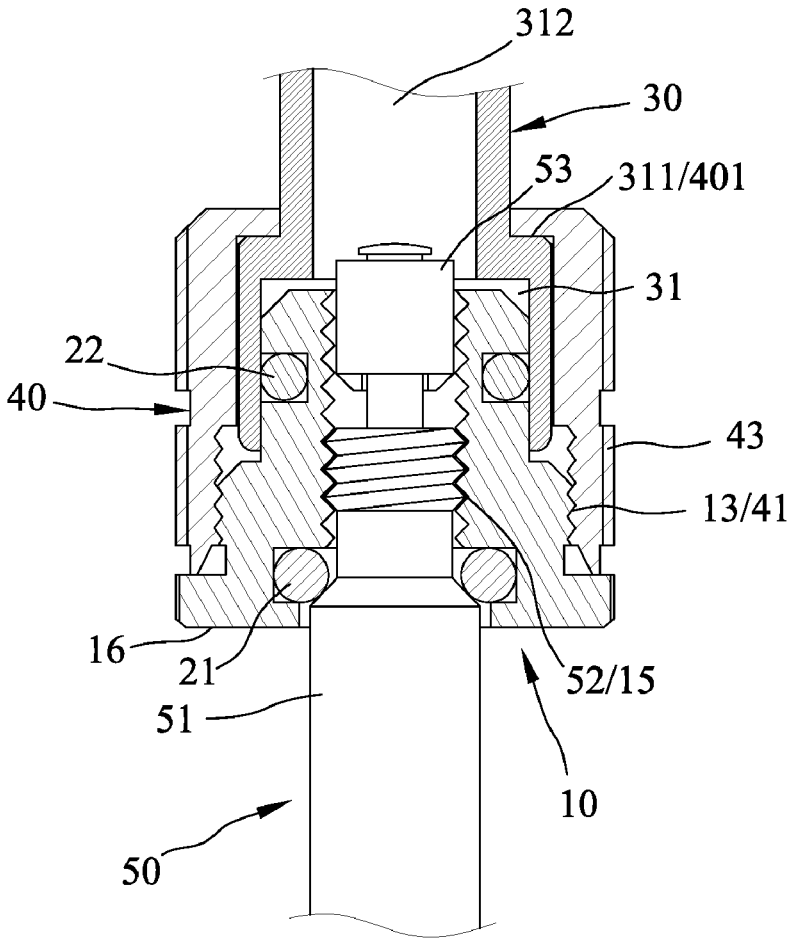
FIG. 7 is a partial cross sectional view to show the connection of the dispensing head of the present invention and the French valve.

Referring to FIGS. 6 and 7, the end having the chamber 31 of the sleeve 30 is received in the housing 40 and the tubular portion of the sleeve 30 extends through the through hole 42 so as to assemble the sleeve 30 and the housing 40. The inner end 401 of the housing 40 is engaged with the stepped surface 311 of the sleeve 30. The mount piece 10 is connected to the housing 40 by engaging the first and second connection portions 41, 13. A flange with an end surface 16 is located on the second end of the mount piece 10 and the flange includes a diameter larger than an outer diameter of the first end of the housing 40. An outlet 11 is defined in a center of the end surface 16 and communicates with the central passage in the mount piece 10. The flange allows the user to rotate the mount piece 10 to securely connect the mount piece 10 to the housing 40. It is noted that the first connection portion 41 of the housing 40 can be threadedly connected with the second connection portion 13 of the mount piece 10. The first connection portion 41 of the housing 40 may be a convex/concave portion and the second connection portion 13 of the mount piece 10 is a concave/convex portion which is engaged with the first connection portion 41. The first connection portion 41 of the housing 40 may also be force fitted with the second connection portion 13 of the mount piece 10. The flange can be welded or adhered to the housing 40 to let the housing 40 and the mount piece 10 to be a one-piece member.

When the French valve 50 is connected to the dispensing head of the present invention, the inner threads 15 of the mount piece 10 is threadedly connected with the threaded section 52 and the inlet valve 53 is inserted into the chamber 31. A part of the shank 51 of the French valve 50 is inserted into the mount piece 10 via the outlet 11 and the second seal ring 21 is mounted to the inclined surface of the neck to seal the connection between the mount piece 10 and the French valve 50, so that the air pump can deliver pressurized air into the French valve 50.

The present invention provides a dispensing head that is threadedly connected with the latest French valve and the connection is leakage free. The first and second seal rings ensure the leakage free feature can be achieved. The dispensing head of the present invention is compact and provides satisfied sealing feature when connecting with the French valve.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A dispensing head for an air pump, comprising:

a sleeve including a tubular portion and an enlarged portion, the tubular portion having a passage defined therethrough, a chamber defined in the enlarged end of the sleeve, the chamber communicating with the passage;

a housing having a first connection portion defined in a first end thereof and a through hole defined through a second end of the housing, the enlarged end having the chamber of the sleeve being received in the housing; and a mount piece having a first groove defined in an outside thereof and a first seal ring engaged with the first groove, a second connection portion defined in the outside of the mount piece and connected with the first connection portion so as to receive the mount piece in the housing, a first end of the mount piece being inserted in the chamber and enclosed by the enlarged end of the sleeve, the enlarged end of the sleeve surrounding the first ring and the first groove, the enlarged end of the sleeve located between the housing and the first ring, the first seal ring being in contact with an inner periphery of the chamber, a plurality of inner threads defined axially in a central passage in the mount piece and adapted to be connected with a threaded section of a French valve, a second groove defined in the mount piece and located close to a second end of the mount piece, a second seal ring engaged with the second groove and adapted to be mounted to a neck of the French valve, with the second end of the mount piece having an outlet in communication with the central passage of the mount piece, with the second groove located between the plurality of inner threads and the outlet of the mount piece, the second connection portion axially spaced from the first groove, the first connection portion located between the first groove and the second groove.

2. The dispensing head as claimed in claim 1, wherein the first connection portion of the housing is threadedly connected with the second connection portion of the mount piece.

3. The dispensing head as claimed in claim 1, wherein the first connection portion of the housing is a convex/concave portion and the second connection portion of the mount piece is a concave/convex portion which is engaged with the first connection portion.

4. The dispensing head as claimed in claim 1, wherein the first connection portion of the housing is force fitted with the second connection portion of the mount piece.

5. The dispensing head as claimed in claim 1, wherein the first connection portion of the housing is adhered to the second connection portion of the mount piece.

6. The dispensing head as claimed in claim 1, wherein the housing includes a serrated outer surface.

7. The dispensing head as claimed in claim 1, wherein a flange with an end surface is located on the second end of the mount piece and the flange includes a diameter larger than an outer diameter of the first end of the housing, the second connection portion located between the first end of the mount piece and the flange, the second connection portion of the mount piece having an outer diameter smaller than the diameter of the flange and larger than an outer diameter of the first end of the mount piece.

8. The dispensing head as claimed in claim 7, wherein the outlet is defined in a center of the end surface.

9. The dispensing head as claimed in claim 1, wherein the first seal ring is made by rubber.

* * * * *